United States Patent [19]

Ross et al.

[11] Patent Number: 4,552,218

[45] Date of Patent: Nov. 12, 1985

[54] UNLOADING INJECTION CONTROL VALVE

[75] Inventors: Richard J. Ross; David J. Speller, both of Houston, Tex.

[73] Assignee: Baker Oil Tools, Inc., Orange, Calif.

[21] Appl. No.: 535,409

[22] Filed: Sep. 26, 1983

[51] Int. Cl.[4] ..... E21B 34/10

[52] U.S. Cl. ..... 166/319; 166/325; 166/321

[58] Field of Search ..... 166/321, 319, 324, 183, 166/184, 141, 142, 145, 150, 151, 185, 186, 188, 321, 324, 325

[56] References Cited

U.S. PATENT DOCUMENTS

| | | | |
|---|---|---|---|
| 2,338,369 | 1/1944 | Williams et al. | 166/145 |
| 3,105,553 | 10/1963 | Chisholm | 166/150 |
| 3,850,250 | 11/1974 | Holden et al. | 166/319 |

*Primary Examiner*—Stephen J. Novosad
*Assistant Examiner*—M. Goodwin
*Attorney, Agent, or Firm*—Norvell & Associates

[57] ABSTRACT

A valving apparatus for use in controlling the fluid pressure in a subterranean well conduit and in the annulus surrounding the conduit is disclosed. The valving apparatus is shiftable between a closed position and an open position allowing flow within the tubing by the application of fluid pressure in the tubing above the valve. Pressure equalization below the valve is provided when the valve is in the closed position thus permitting the tool to be used with well tools in which annulus and tubing pressure must be equalized. A plug located within the valve prevents the flow of fluids through the conduit in either direction. An annular fluid bypass does permit flow around the plug when the valve is in the open position.

9 Claims, 15 Drawing Figures

UNLOADING INJECTION CONTROL VALVE

BACKGROUND OF THE INVENTION

1. Field of the Invention

The invention relates to a valve apparatus for use in a subterranean fluid transmission conduit or work string in which fluid pressure above the valving apparatus can be used to open the valve to permit fluid pressure to act at a location below the valve.

2. Description of the Prior Art

There are many downhole tools and operations which require the injection of fluid through a tubing conduit to the producing formation or some other location within the well or which require the use of fluid pressure applied through the tubing. For example, washing or acidizing operations require fluid injection through the tubing bore. Some tools also incorporate fluid pressure actuated expandable packing elements which are expanded into sealing engagement with the wall of the casing upon the application of fluid pressure within the tubing or the tool bore.

Such tubing pressure dependent operations or well tools generally not only require the injection of fluids through the tubing bore or the application of pressure within the tubing, but often require control over the relative fluid pressures in both the tubing and in the annulus between the tubing or fluid transmission conduit and the well bore or casing. For example, the pressure actuation of the downhole tool, such as a tool having expandable packing elements, may be dependent upon the force generated by the pressure differential existing between the tubing and the annulus. To set or expand the packing elements, the pressure in the tubing, in general, must exceed the pressure in the annulus. Conversely to permit the expanded packing elements to relax, the pressure in the tubing must generally be less than the pressure in the annulus. In low fluid level wells, the annulus fluid pressure may be continuously less than the hydrostatic pressure in the fluid transmission conduit or work string. Thus any operation dependent upon a greater pressure in the annulus than in the tubing would be difficult to perform. For example, a well tool having an expandable packing element actuated by excess fluid pressure in the tubing may be difficult to retract when tubing pressure is reduced because the hydrostatic pressure in the tubing will still exceed the pressure acting on the packing elements in the annulus. Similarly, the excess pressure differential in the tubing may prevent the movement of a tool having a cup type packing element because of the pressure difference between the tubing and the annulus. A simple reliable apparatus for controlling the pressure in the tubing and in the annulus of certain wells, such as wells having a low fluid level, and of equalizing the pressure between the tubing and the annulus is therefore highly desirable. In addition to controlling the relative pressures in the tubing and the annulus, it is highly desirable that such a tool also controls the fluid levels in the tubing and in the annulus during pressure changes. For example, when the pressure is reduced in the tubing, sudden fluid level surges within the tubing, possibly resulting in surface contamination, should be avoided. It is therefore an object of this invention to provide such a tool especially adapted for use in low fluid level wells.

SUMMARY OF THE INVENTION

A valve apparatus for use in a fluid transmission conduit, such as a tubing or work string, in a subterranean well, such as an oil or gas well, employs fluid pressure changes within the tubing to operate the valve. The valve employs a plug affixed within the bore of the valving apparatus to prevent the continuous flow of fluid through the bore of the valving apparatus in either direction. An annular fluid bypass communicable with the bore of the valving apparatus and of the well conduit above and below the plug provides a means of transmitting fluid through the conduit and valving apparatus when the valve is in the open position.

A shuttle valve shiftable relative to the centrally disposed plug opens and closes the fluid communication path between the fluid bypass and the bore of the valving apparatus on one side of the plug. For example, in the preferred embodiment of this invention, the shiftable shuttle valve opens and closes the fluid communication path below the plug. Fluid can then be injected through the upper fluid transmission conduit then through the annular fluid bypass and into the valve apparatus and fluid transmission conduit below the centrally disposed plug.

Normally, the shuttle valve in the preferred invention is spring biased to a closed position preventing the flow of fluids from the surface of the well to a subsurface location below the plug. In the preferred embodiment of this invention, the spring loaded shuttle valve includes a separate communication path or radial port permitting fluid communication between the annulus surrounding the valving apparatus and the tubing below the plug when the shuttle valve is in the closed position. Again in the peferred embodiment, actuation of the shuttle valve to move the valve to the open position also closes the radial path permitting pressure unloading or equalization between the lower tubing and the annulus. When pressure is reduced in the tubing string above the plug, the shuttle valve closes the fluid communication path through the tubing and again opens the radial port permitting communication between the annulus and the lower fluid transmission conduit. Not only will movement of the shuttle valve to the closed position permit fluid equalization between the annulus and tubing in a tool located below the valve, but any fluids tending to flow into the tubing below the valve are prevented from flowing up the tubing to the surface of the well. Such fluids can only pass into the annulus, where the pressure remains equalized, preventing any undesirable fluid loss and permitting the operator to maintain control and fluid and pressure integrity of the well. Such control is highly desirable for safe operation of the well.

DESCRIPTION OF THE PREFERRED EMBODIMENT

Figure 1:
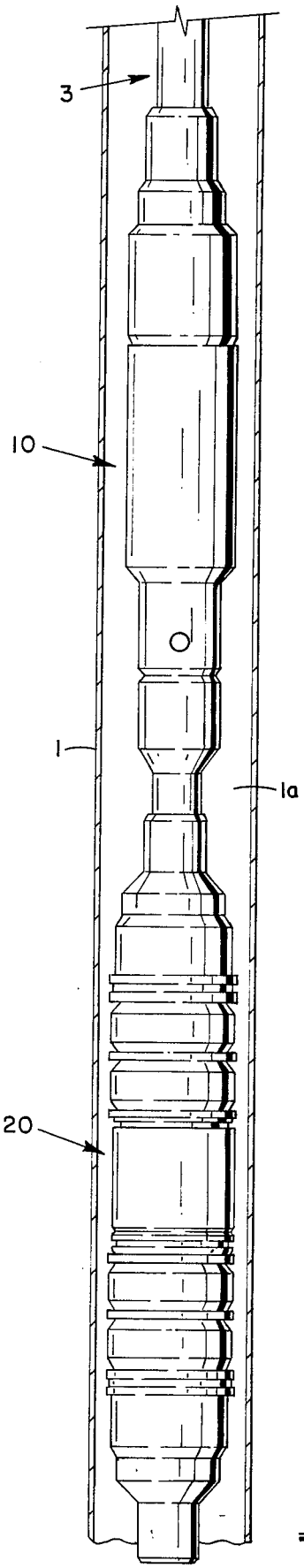
FIG. 1 is a schematic elevational view of a valving apparatus involving this invention, shown in assembled relationship to a perforation washer and mounted within the casing of a well.
Figure 3A:
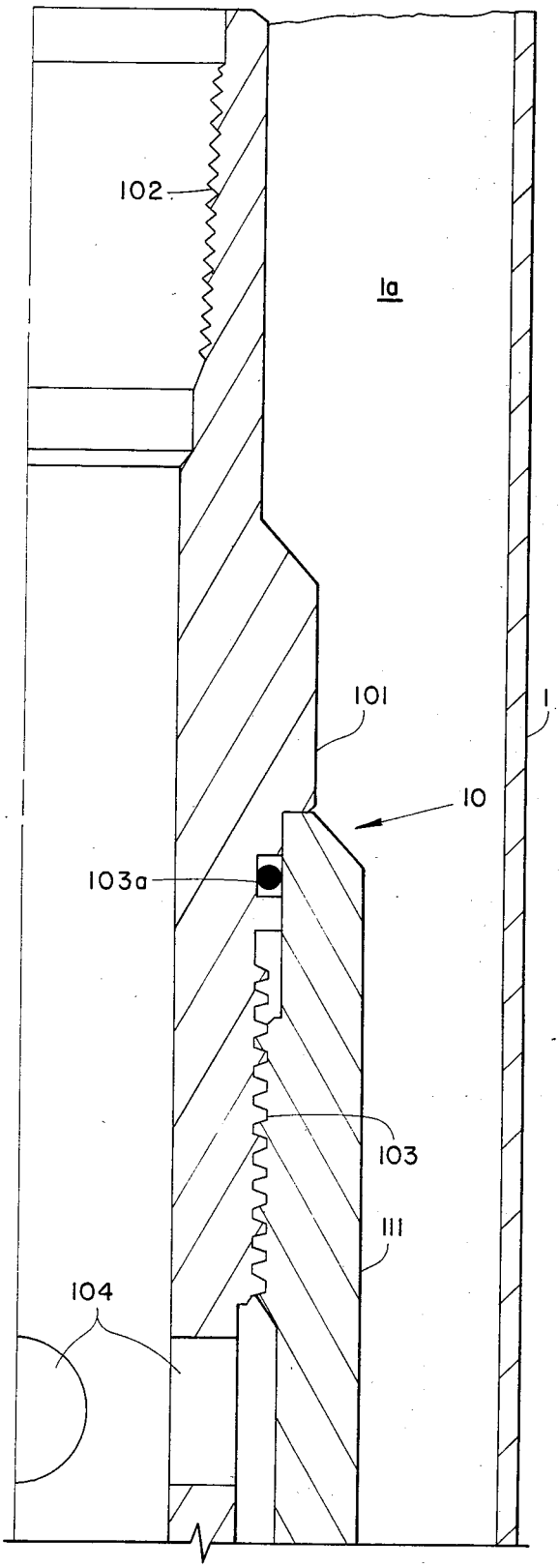
FIGS. 3A–3G are views respectively similar to views 2A–2G but showing the elements of the apparatus in their operative positions when the packing elements of the perforation washer are expanded into engagement with the well casing.

The valving apparatus involving this invention may be employed for controlling the application of fluid pressure or the injection of fluids in a number of completions in a subterranean well. For example, fluid pressure may be applied to expandable packing elements disposed in an annulus defined between two concentric well conduits.

For simplicity, the invention will be described in connection with the control of fluid pressure to a conventional perforation washer 20 which is suspended on the end of the valving apparatus 10 and inserted within the well casing 1 by a tubular work string or fluid transmission conduit 3. These elements define an annulus 1*a* between the inner wall of the casing 1 and the outer wall of the interconnected apparatus including perforation washer 20, valving apparatus 10, and tubular work string 3.

Referring now to the enlarged scale drawings of FIGS. 2A–2G, the valving apparatus 10 will be seen to comprise a tubular body assemblage 100 formed by the threaded interconnection of an upper body element or mandrel 101, two intermediate body elements 111 and 121, and a lower body element 131. Mandrel 101 is provided with internal threads 102 for connection to the tubular work string 3 or any other suitable well conduit. Mandrel 101 is further provided on its medial portion with external threads 103 for threadably receiving the upper end of the intermediate body element 111. This threaded juncture is sealed by an O-ring seal 103*a*. Intermediate body member 111 is provided at its lower end with external threads 112 for threadable attachment to the top end of the lower intermediate body element 121. The bottom portion of the intermediate body element 121 is provided with external threads 122 for threadable connection to a lower body element 131. Body element 131 has threads 132 connecting to the top end of the perforation washer unit 20.

The medial portion of the mandrel 101 is further provided with a plurality of radial ports 104. At the extreme bottom end of the mandrel 101, a plug 106 is affixed to the mandrel. An upper annular elastomeric mass 107 of sealing material is mounted within a channel 106*a* adjacent plug 106. Both the plug 106 and the elastomeric mass 107 are secured to the bottom portion of the mandrel 101 by a retaining sleeve 108 which engages threads 101*a* provided on the upper tubular body portion 101. The upper elastomeric mass 107 will thus be seen to provide an annular, downwardly facing sealing surface 107*a*. An O-ring 106*b* seals the abutting end face connection between the plug 106 and the bottom end of the mandrel 101. Plug 106 prevents fluid from passing continuously through the bore of the mandrel 101 and the interconnected work string 3 in either axial direction. In the preferred embodiment of this invention, plug 106 is attached to mandrel 101. Of course the plug 106 could be secured within mandrel 101 by other means. For example, plug 106 could be secured by means of a conventional lock having dogs engaging cooperating nipple grooves on the interior of the mandrel bore. Conventional locks suitable for use in such an alternate embodiment would be capable of holding a suitable plug, such as a conventional tubing blanking plug against both upwardly and downwardly acting fluid pressure forces, just as plug 106.

The upper intermediate tubular body element 111 is spaced outwardly relative to the lower portions of the upper tubular body element 101 to define an annular fluid bypass 111*a* therebetween. Near the bottom of the threads 112, the intermediate tubular body element 111 is provided with an internally projecting shoulder portion 113 defining a cylindrical bearing surface 113*a*. As will be later described, this bearing surface 113*a* slidably cooperates with an external cylindrical bearing surface 50*a* provided on a tubular shuttle valve 50. An O-ring seal 113*b* effects a seal with the bearing surface 50*a* of the shuttle valve 50 so that a fluid pressure chamber is defined by annular fluid bypass 111*a*.

The lower end of the lower intermediate tubular body element 121 defines an internal cylindrical bearing surface 123 which slidably cooperates with the external cylindrical surface 51*a* of a sleeve 51 which is secured to the bottom end of the shuttle valve 50 in a manner to be hereinafter described. Additionally, the lower tubular body 121 is provided with axially spaced, radial ports 125 and 126 to maintain the annulus 124 between the exterior of the shuttle valve 50 and the interior bore surface 123 of the intermediate body element 121 at the same fluid pressure as the casing annulus 1*a*.

A sealing sleeve 117 is slidably mounted within the lower portion of the lower intermediate tubular body element 121 and is maintained in an upper position by a spring 118 acting against the bottom of the sealing sleeve 117 and an internal shoulder 133 defined just below the threads 122 providing the connection to the lower tubular body element 131. An enlarged shoulder 117*a* on sealing sleeve 117 cooperates with internally projecting, downwardly facing shoulder 121*c* provided on the intermediate tubular body element 121. The top portion of the sealing sleeve 117 defines an upstanding beaded ridge 117*b* which functions as a sealing surface and cooperates with an annular elastomeric mass 55 provided on the bottom of the shuttle valve 50, in a manner to be hereinafter described.

A first seal support sleeve 51 (FIG. 2C) is mounted around the lower portions of the tubular body of the shuttle valve 50 and is secured in the desired axial position by a C-ring 52. The first seal support sleeve 51 is provided with a lower externally threaded portion 51*b* which cooperates with internal threads provided on a second seal retainer sleeve 53. A third seal support sleeve 54 is sealably mounted on the bottom of shuttle valve 50 and sealed thereto by an O-ring 54*a*. The lower portions of sleeve 53 and 54 are shaped to define a recess for receiving the annular elastomeric sealing mass 55 and retaining such mass in position to be engaged by the upstanding sealing ridge 117*b* whenever the shuttle valve 50 is moved downwardly.

Figure 2A:
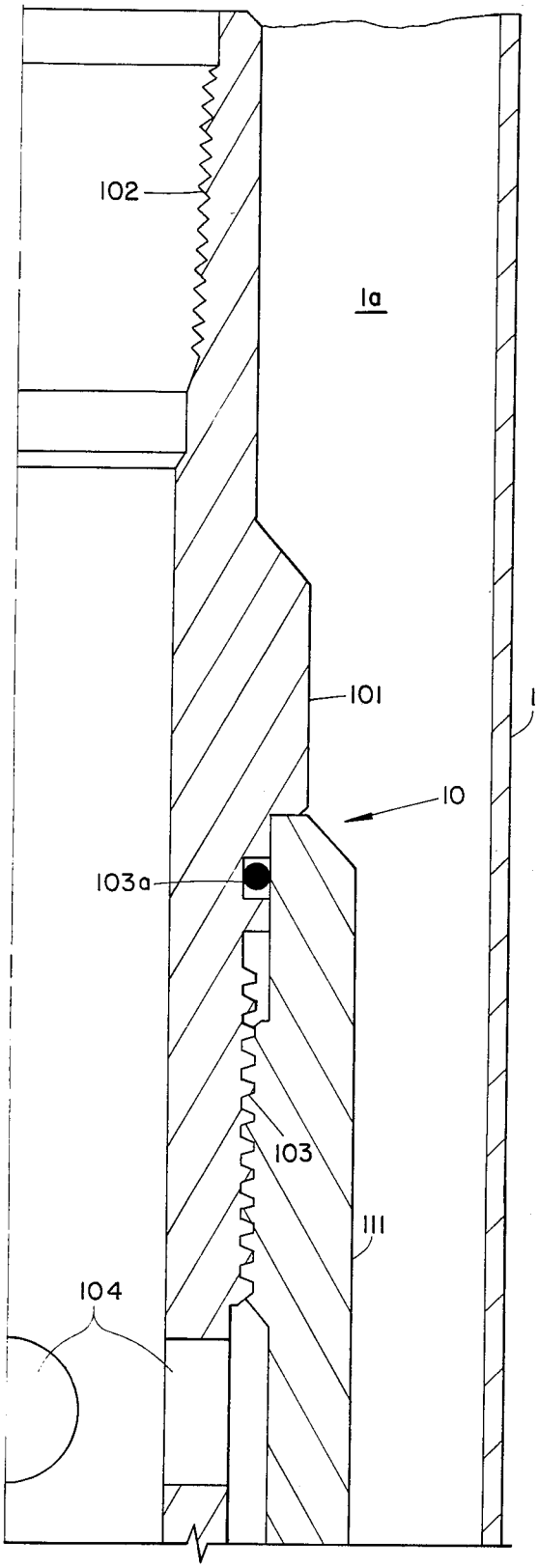
FIGS. 2A–2G collectively constitute an enlarged scale quarter sectional view of the apparatus shown in FIG. 1, with the elements thereof shown in their run-in positions.
Figure 2B:
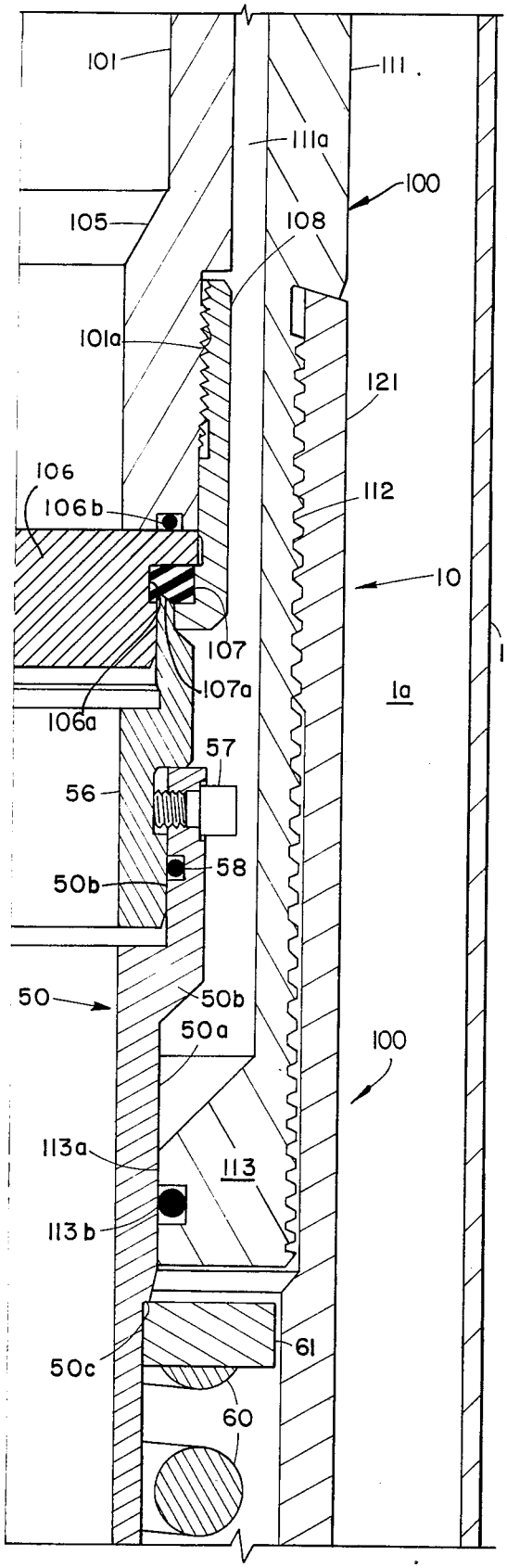

The upper end of the tubular shuttle valve 50 is provided with an enlarged counterbored portion 50*b* (FIG. 2B) and a sealing sleeve 56 is secured thereto by a set screw 57 and sealed to the counterbore by an O-ring seal 58. The sealing sleeve 56 is provided at its upper end with an upstanding annular ridge sealing member 56*a* which cooperates with the annular elastomeric mass 107 to achieve a sealing engagement therewith whenever the shuttle valve 50 is in its uppermost position, as illustrated in FIG. 2B. The outer upwardly facing surfaces of valve 50 and sleeve 56 constitute piston surfaces disposed in the annular fluid bypass 111*a*.

Shuttle 50 is resiliently biased to remain in its uppermost position by a helical spring 60 which surrounds the medial portion of the tubular shuttle valve 50 and abuts at its upper end against a ring 61 which in turn abuts against a downwardly facing shoulder 50*c* provided on the tubular shuttle valve 50. At its lower end, spring 60 abuts a ring 62 which is supported by a plurality of spacer rings 63. The number of spacer rings employed and the axial height of each depends upon the amount of pressure that is selected to maintain the shuttle valve in its closed upper position with respect to the downwardly facing elastomeric seal 107. Spacer rings 63 are in turn supported on an upwardly facing shoulder 121*d* provided on the intermediate tubular body portion 121.

As previously mentioned, the valving apparatus 10 embodying this invention is series connected between the tubular work string 3 and a downhole tool, such as a perforation washing tool 20. This invention may be advantageously employed in other applications including with any type of downhole tool wherein a fluid pressure actuated expandable packing element is expanded into sealing engagement across the annulus 1*a*. The washing tool 20 illustrated in the drawings is entirely conventional, and may, for example, comprise a Model C Packing Element Circulating Washer sold by Baker Service Tools Divisions of Baker Oil Tools, Inc. Accordingly, no detailed description of the construction of such tool will be made beyond pointing out the major components thereof.

Thus, the tool 20 comprises an outer hollow housing 201 on which are mounted a plurality of expandable elastomeric sealing elements 202, 203, 204, and 205. These elastomeric elements are concurrently axially compressed through the expansion of two telescopically related piston elements 210 and 211. Pressurized fluid for axially separating the piston elements 210 and 211 is supplied to a fluid pressure chamber 212 defined between the two telescopically related piston elements, through a radial port 213 which communicates with the hollow bore 20*a* of the washing tool 20, hence with the bore of the tubular housing assemblage 100.

Ordinarily, the elastomeric elements 202–205 are expanded through the introduction of fluid pressure into the bore 20*a* of the washing tool 20 in excess of the hydrostatic pressure existing in the casing annulus 1*a*. A suitable valve (not shown) is provided in the bore 20*a* below port 213. If the annulus 1*a* is filled with fluid, the hydrostatic pressure existing in such annulus will generally be the same as the hydrostatic pressure existing within the bore 20*a*. As the pressure in the bore 20*a* is increased, the increased fluid pressure is applied through port 213 to the fluid pressure chamber 212, thus separating the telescopically related pistons 210 and 211 to exert a compressing force on the expandable elastomeric elements 202–205. Thus, the elastomeric elements 202–205 are compressed and displaced radially to move into sealing engagement with the inner wall of the casing 1, as illustrated in FIGS. 3E, 3F, and 3G.

A conventional pressure relief valve 215 is provided in the wall of the housing tool 20 at a position adjacent the telescopically related pistons 210 and 211. In fact, the piston 211 is provided with an axial slot 211*a* (FIG. 2F) to receive the outer end of the pressure relief valve 215. Valve 215 is provided with a bleed passage 215*a* and is spring biased to a normally closed position. Upon a sufficient increase in fluid pressure after the setting of the expandable elastomeric elements 202–205, the pressure relief valve 215 will open and permit a large volume flow outwardly from the washing tool and through the selected set of perforations 1*c* in the casing wall 1 which is located between the innermost elastomeric sealing elements 203 and 204. Thus, a washing fluid can be injected through the perforations 1*c* into the fractures of the producing zone.

In a well where the hydrostatic casing annulus fluid pressure is equal to the hydrostatic pressure existing in the bore of the inner conduit, the washing operation can be discontinued and the elastomeric packing elements 202–205 released simply by terminating the application of the fluid pressure to the work string. However, in those wells having a low fluid level, it often happens that the hydrostatic fluid pressure of the column of fluid contained in the interconnected work string and wash tool is substantially in excess of the ambient hydrostatic pressure existing in the casing annulus. In such event, it is not possible to effect the release of the expansible elastomeric packing elements 202–205 merely through reduction of the fluid pressure in the work string. The valving apparatus 10 involving this invention is specifically directed to resolving this problem, and it operates in the manner hereinafter described.

OPERATION

During run-in of the interconnected washing apparatus 20, valving apparatus 10 and work string 3, fluid communication is maintained between the annulus surrounding the fluid transmission conduit, or work string 3 and the bore 20*a* below plug 106 through the open annular port defined between sealing sleeve 117 and seal 55. Fluid can be injected into the bore of the fluid transmission conduit, or work string 3, above the plug 106 so that the fluid pressure in the bore is generally equal to the hydrostatic pressure in the annulus and the pressure below plug 106. Shuttle valve 50 remains in the position shown in FIGS. 2B and 2C because of the action of spring 60.

When the washing apparatus 20 or other apparatus incorporating a fluid pressure expansible packing element is positioned at its desired downhole location, the elements of the apparatus will be in their positions shown in FIGS. 2A–2G. Fluid pressure above the plug 106 can then be increased at the well head and such increased fluid pressure flows outwardly through the radial port 104 into annular fluid bypass 111*a*. Such fluid pressure acts on the upwardly facing outer surfaces of the shuttle valve 50 and sleeve 56. There is a greater area of upwardly facing surfaces on such elements than downwardly facing surfaces exposed to the higher fluid pressure flowing into fluid bylass 111*a*. When fluid pressure in bypass 111*a* is increased sufficiently, the sleeve 56 and shuttle valve 50 are forced downwardly. Such downward movement against the action of spring 60 effects the opening of the sealing engagement between the upstanding annular sealing ridge 56*a* on shuttle valve 50 and the annular elastomeric mass 107, thus permitting the pressure fluid to flow within the bore of the tubular shuttle valve 50 below plug 106. Concurrently, the annular elastomeric mass 55 mounted on the bottom end of the shuttle valve 50 is moved into sealing engagement with the upstanding sealing ridge 117*b* provided in the lower portions of the lower intermediate body element 121. Thus the increased fluid pressure is applied through the bore of tubular shuttle valve 50 into the bore of the intermediate body element 121, thence, into the bore of the lower tubular body element 131 and into the bore 20*a* of the washing tool 20 to effect the expansion of the elastomeric packing elements 202–205 carried by the washing tool 20. The washing operation then proceeds in normal manner with an appropriate fluid.

Figure 3B:
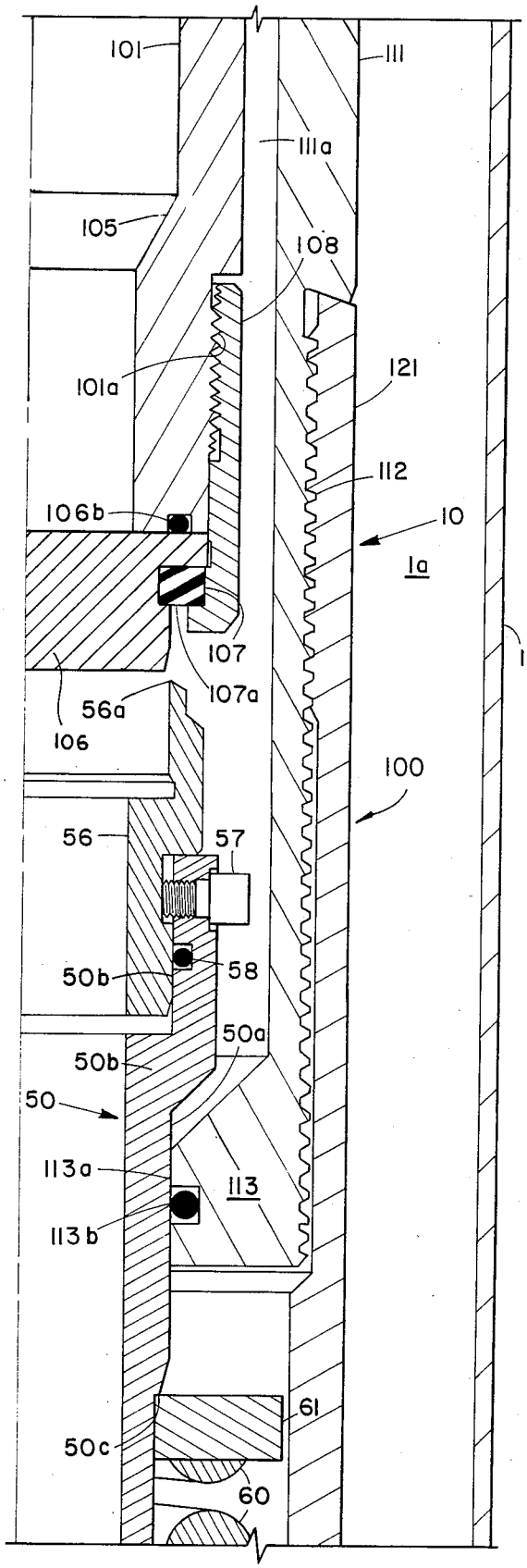
Figure 2C:
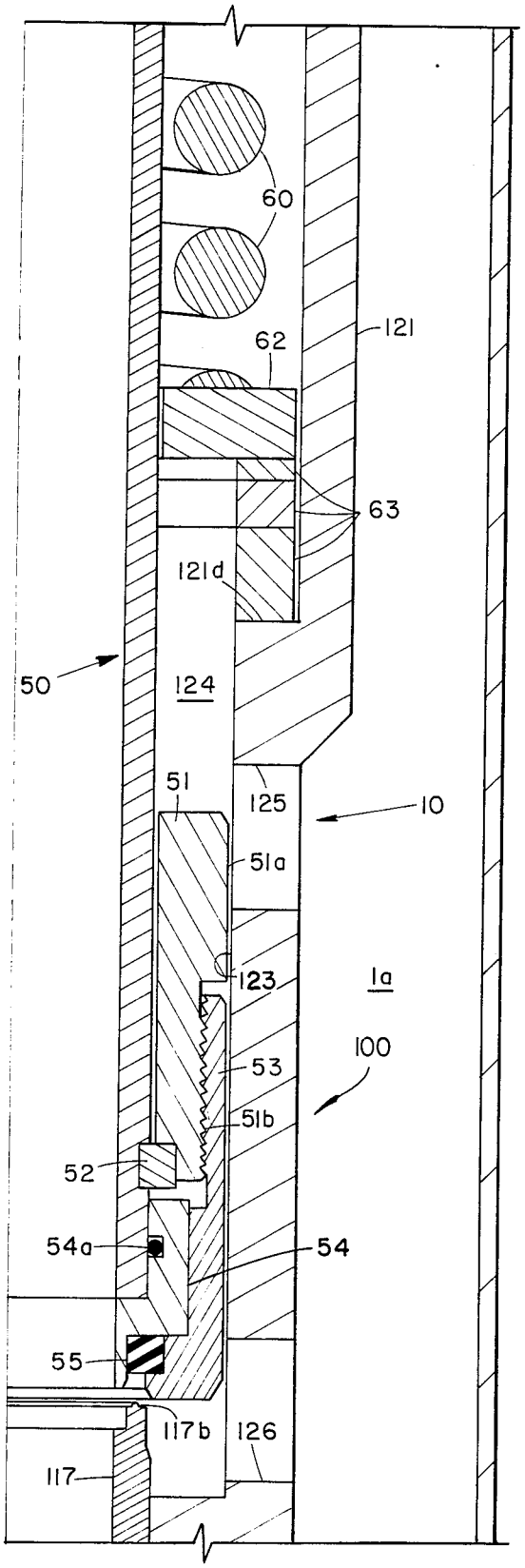
Figure 3C:
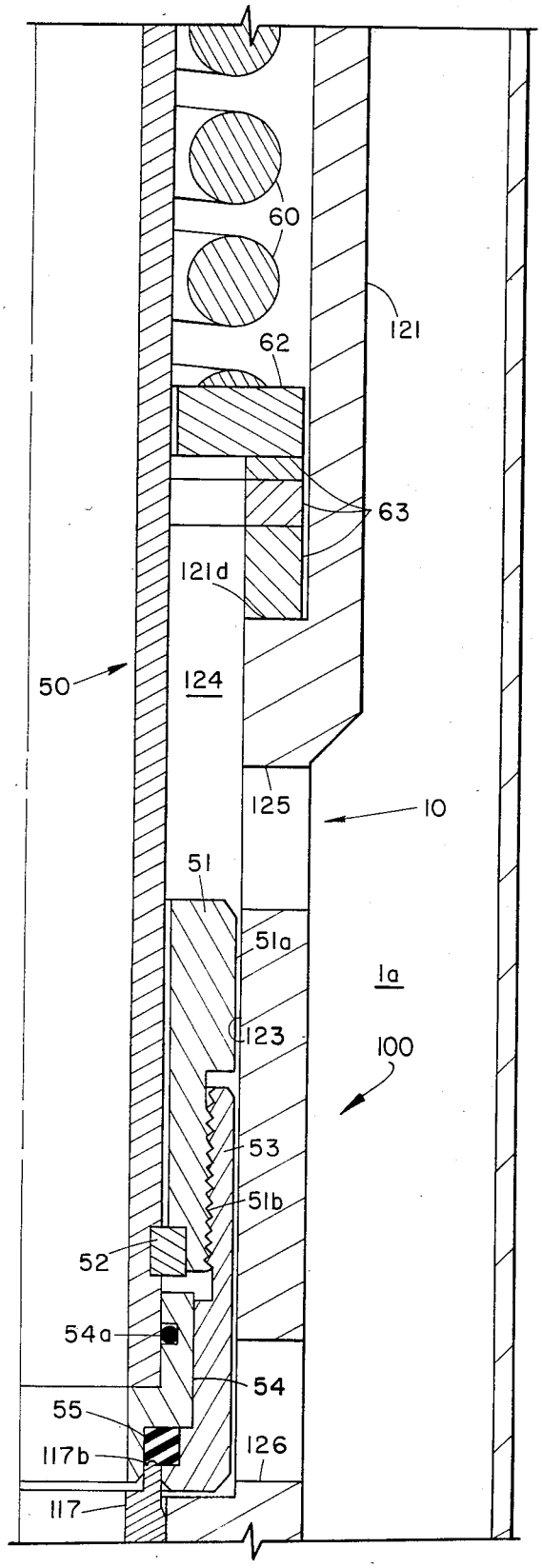
Figure 2D:
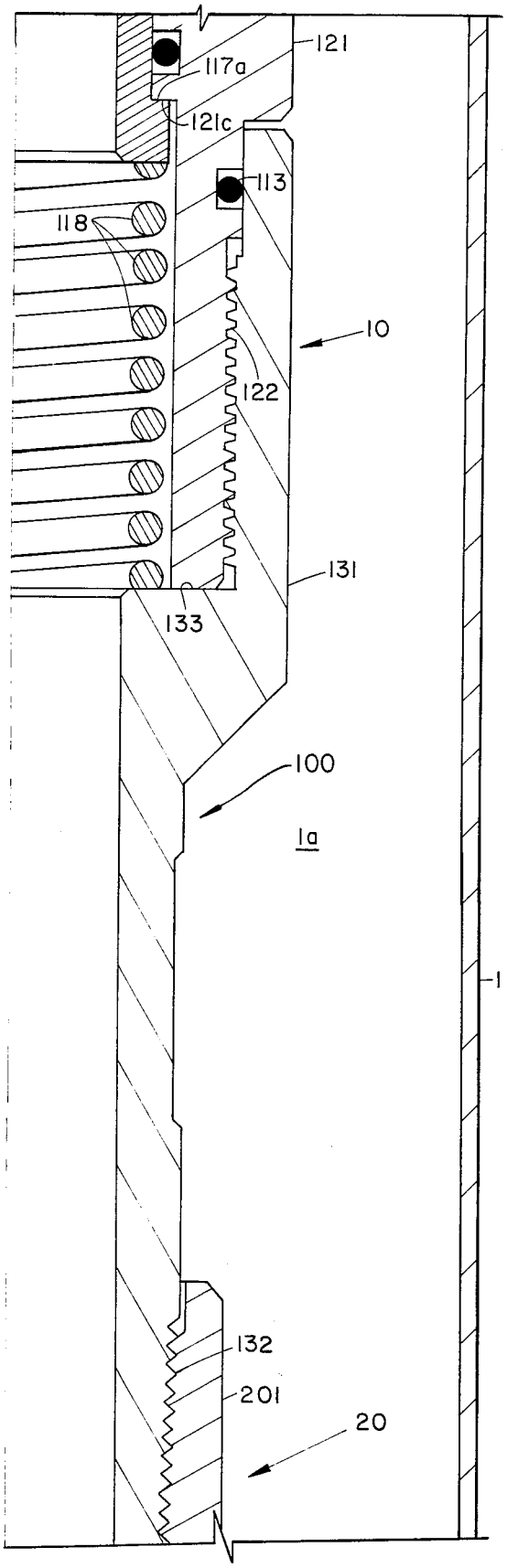
Figure 3D:
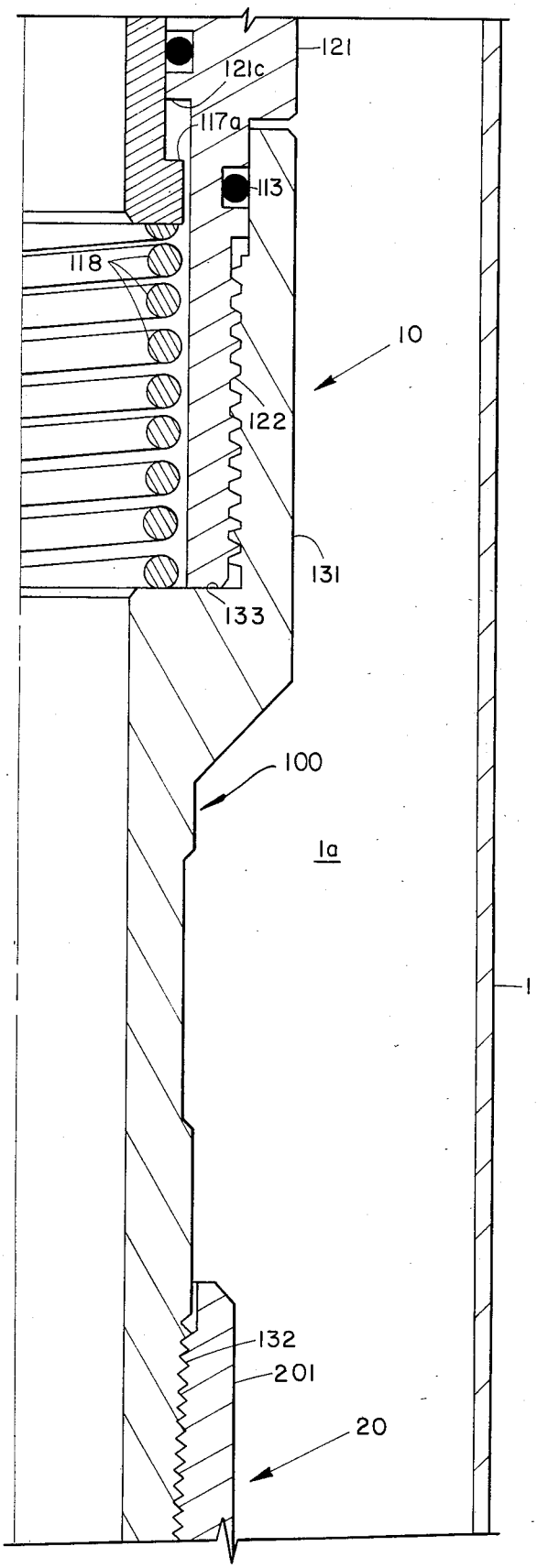
Figure 2E:
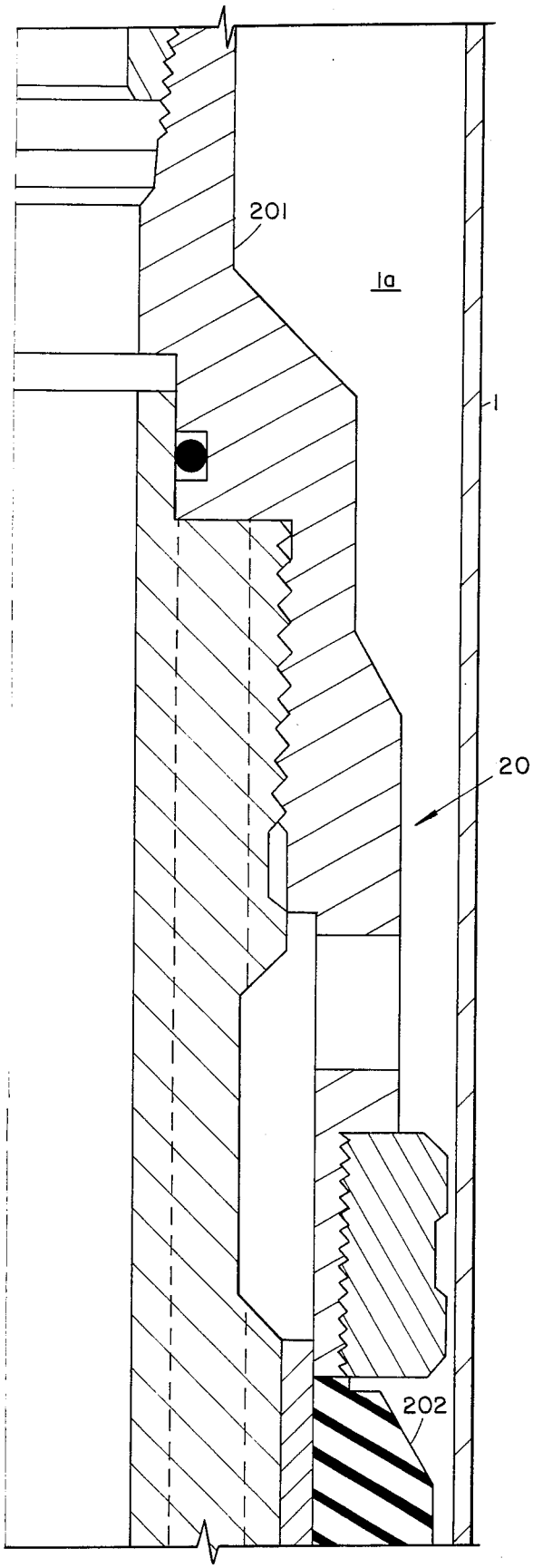
Figure 3E:
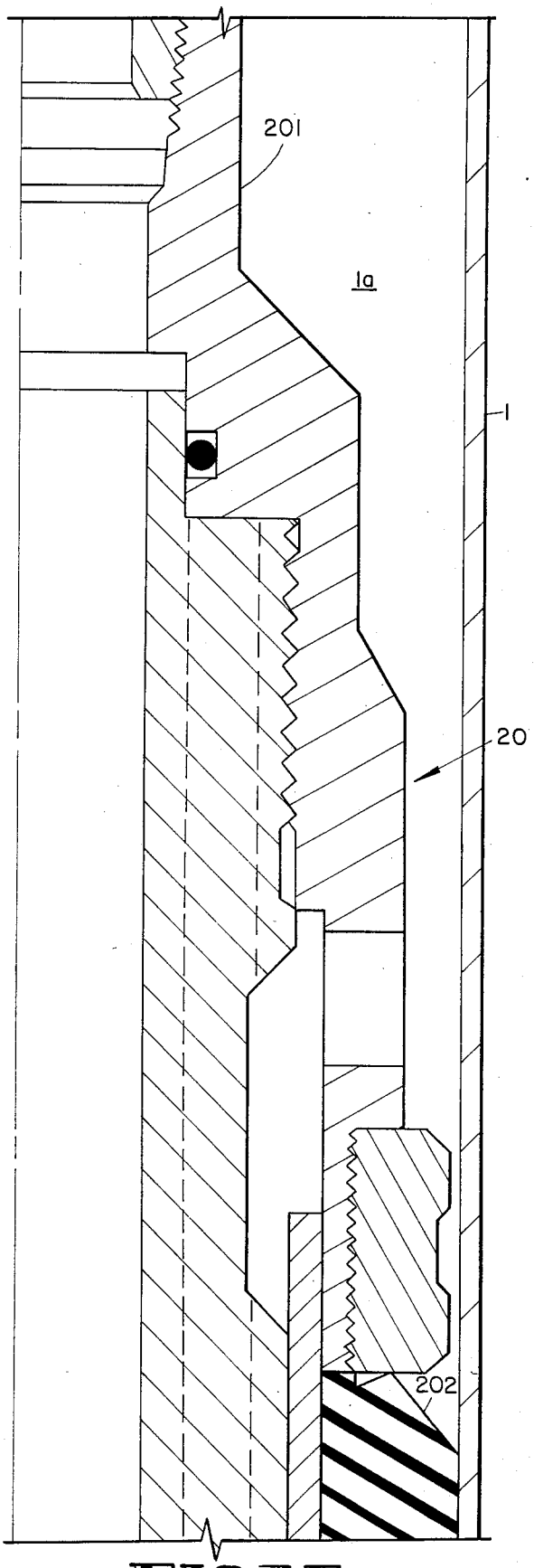
Figure 2F:
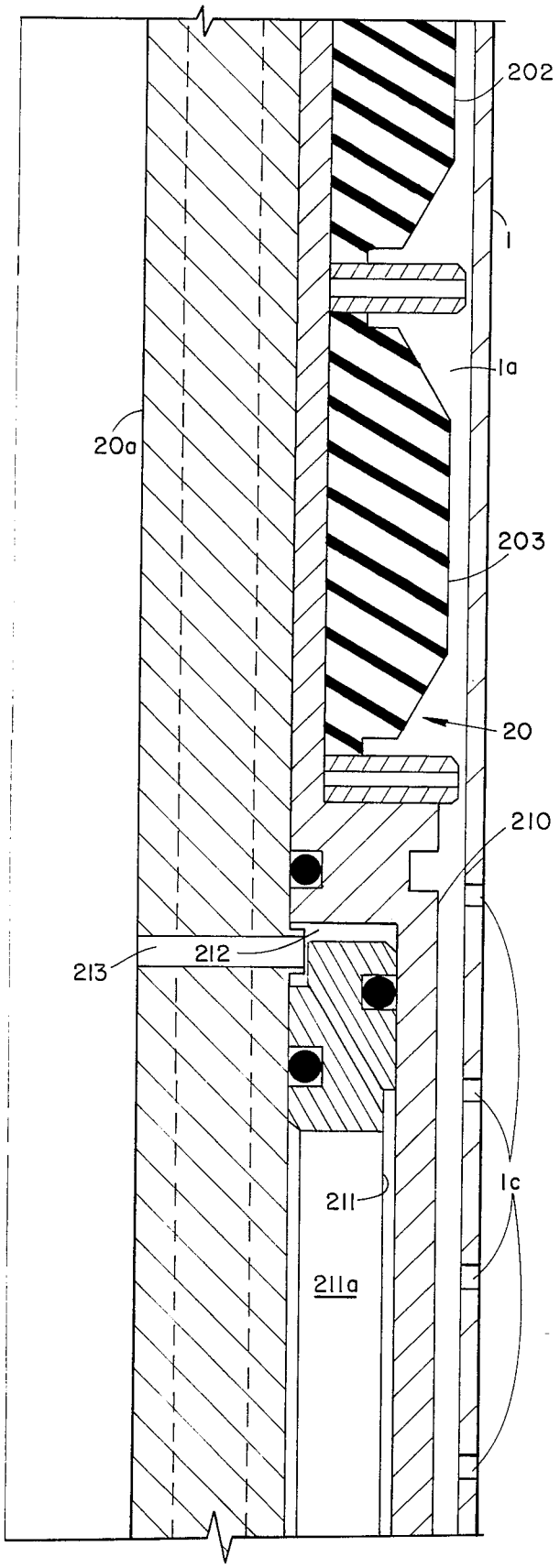
Figure 3F:
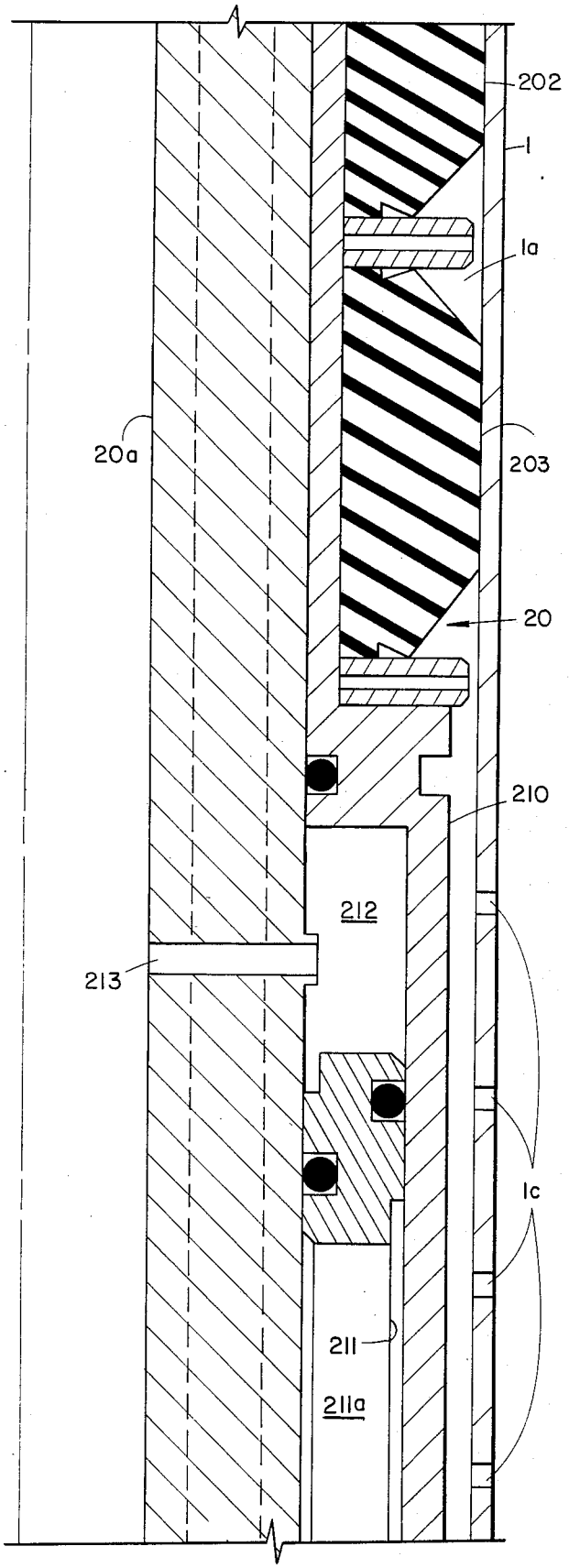
Figure 2G:
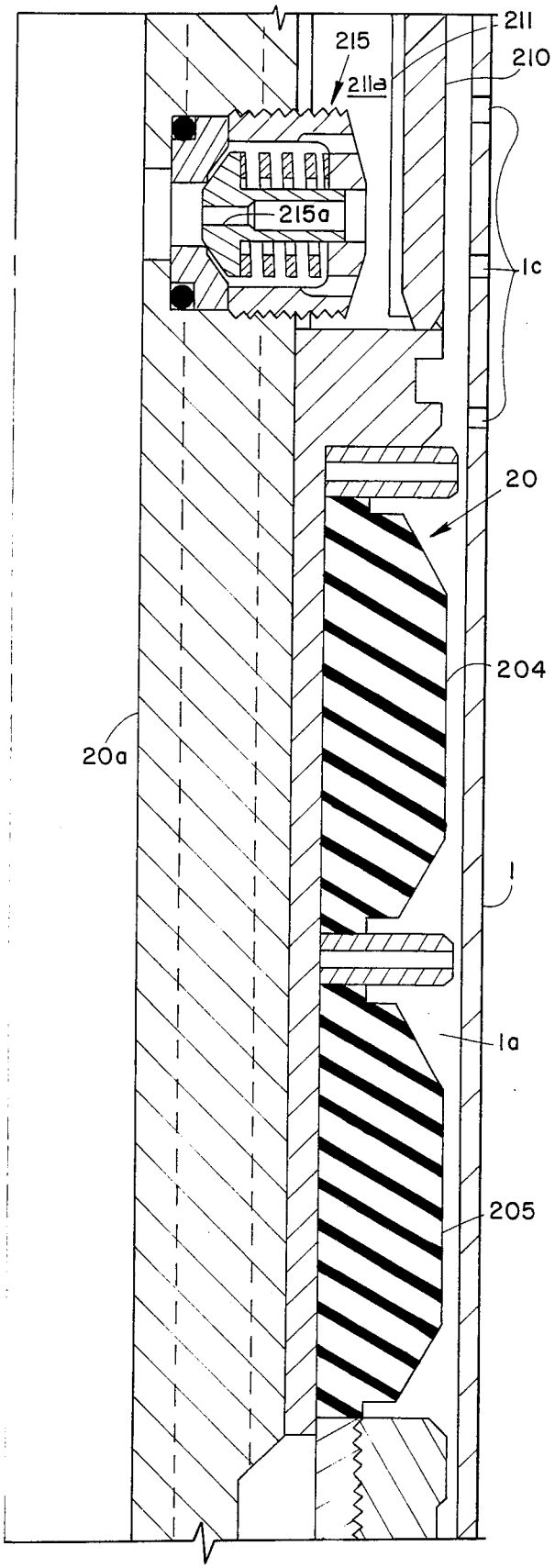
Figure 3G:
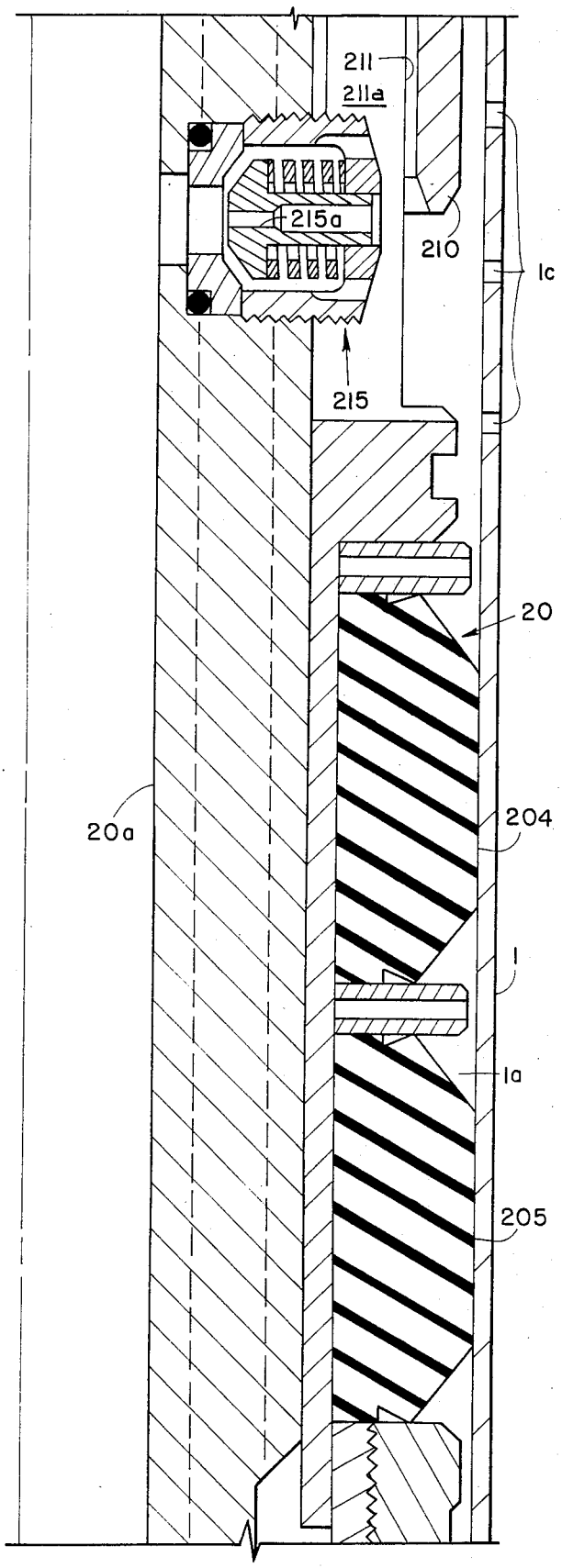

At the conclusion of the washing operation, the fluid pressure is removed at the surface from the bore of the work string 3 and the fluid pressure in the valve apparatus 10 acting to maintain shuttle valve 50 in the position of FIGS. 3B and 3C, returns to the normal hydrostatic pressure represented by the column of fluid contained in the work string 3 and the interconnected valving apparatus 10. The effective downward force on sleeve element 56 and shuttle valve 50 is thus removed and hence the shuttle valve 50 returns to its uppermost position, as illustrated in FIG. 2B, wherein the annular sealing ridge 56*a* is in sealing engagement with the annular elastomeric mass 107. More importantly, an annular gap is concurrently opened between the lower annular elastomeric sealing element 55 and the upstanding sealing ridge 117*b*. This gap permits a ready flow of fluid contained within the interconnected bore of the valving apparatus 10 and the work string 3 below plug 106 through such gap, through the radial ports 126, and into the casing annulus 1*a*, thus equalizing the fluid pressure in the casing annulus with that existing in the bore of the interconnected washing apparatus below the plug 106. The pressure in the annulus acting on elastomeric packing elements 202–205 is thus equal to the pressure acting on pistons 210 and 211 acting to maintain the elements in their expanded configuration. This equalization of pressure permits the annular elastomeric packing elements 202–205 to contract through their normal resilience and return to their run-in positions illustrated in FIGS. 2E, 2F, and 2G. Plug 106 and shuttle valve 50 act as a back check valve to prevent any fluid surges through the bore of the fluid transmission conduit or work string which could cause problems at the surface. Fluid is instead diverted into the annulus.

It is therefore apparent that a valving apparatus embodying this invention provides a reliable supply of pressured fluid to any pressure actuated downhole tool disposed below the valving apparatus or for use in any downhole operation. At the same time, equalization of casing annulus pressure with the pressure contained in the bore below the plug and closed shuttle valve can be effected at any time that the fluid pressure in the interconnected work string, above the plug and shuttle valve, is sufficiently reduced.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Fluid pressure responsive valving apparatus for use with an annular downhole tool having a packing element responsive to a pressure differential between the bore of the tool and the surrounding annulus within the well bore, comprising: a tubular assembly connectable in series relation between a surface-connected well conduit and the downhole tool; plug means for closing said tubular assembly to prevent the passage of fluids in either direction therepast and for permitting fluid pressure within said tubular assembly to be increased; a valve mounted in said tubular assembly and shiftable between first and second positions in response to increased fluid pressure within said tubular assembly; said valve in said first position connecting the bore of said tubular assembly to the annulus; resilient means urging said valve to said first position; said valve in said second position directing conduit fluid pressure into the bore of the downhole tool to expand the packing element thereof; and means responsive to the conduit fluid pressure changes for shifting said valve to said second position against the bias of said resilient means.

2. Fluid pressure responsive valving apparatus for a first subterranean well conduit defining an annulus within a second conduit comprising, in combination: a tubular assembly connectable in series relation with the first well conduit and a downhole tool; an upper annular valve surface mounted in said tubular assembly; a lower annular valve surface mounted in said tubular assembly below said upper annular valve surface; a tubular valving shuttle axially shiftably mounted in said tubular assembly and having axially spaced, upper and lower annular valve surfaces respectively sealingly engagable with said upper and lower valve surfaces on said tubular assembly in upper and lower positions of said valving shuttle; resilient means urging said valving shuttle into engagement with said upper valve surface; a radial port in said tubular assembly communicating between the bore of the tubular assembly and the annulus; means in said tubular assembly defining a fluid pressure chamber sealably cooperating with said valving shuttle; plug means in the bore of said tubular assembly above said upper annular valve surface and below said radial port for permitting fluid pressure in the first conduit to be increased, said plug means preventing the passage of fluids in either direction therepast; and fluid passage means for supplying said increased fluid pressure to said fluid pressure chamber, thereby forcing said valving shuttle downwardly to sealingly engage said lower annular valve surface and transmit said increased fluid pressure to the downhole tool.

3. Valve apparatus for use in a fluid transmission conduit in a subterranean well in which fluids move through the conduit in one direction only, the fluids moving in the opposite direction being directed to the exterior of the conduit, comprising: a mandrel having a bore communicating with said conduit; plug means for closing said mandrel to prevent the passage of fluids in either axial direction therepast; fluid bypass means communicable with said conduit on opposite sides of said plug means; port means communicable between said conduit on opposite sides of said plug means; port means communicable between said conduit and the exterior of said conduit; and a shuttle valve below said plug means shiftable relative to said mandrel between a first and a second position, said shuttle valve closing communication through said conduit and fluid bypass means in said first position while permitting flow through said port means, and preventing flow through said port means in said second position while permitting flow through said fluid bypass means; said shuttle valve being responsive to the pressure differential above and below said plug means, whereby said shuttle valve is shiftable to the second position to allow flow through said conduit and fluid bypass means in said one direction only and is shiftable to said second position to allow flow only on the exterior of said conduit.

4. The valve apparatus of claim 3 further comprising biasing means urging said shuttle valve to said first position.

5. The valve apparatus of claim 3 wherein said plug means is affixed to said mandrel.

6. The valve apparatus of claim 3 wherein said shuttle valve and said plug means define a restricted flow passage therebetween having a constant cross-sectional area during initial relative movement therebetween, the flow between said shuttle valve and said plug means being subsequently increased as said shuttle valve means moves axially away from said plug means.

7. Valve apparatus permitting movement of fluid through a tubular conduit in a subterranean well in a downward direction and preventing fluid from moving therepast in the opposite direction, said valve comprising: an outer housing; an inner mandrel having a bore therethrough, one portion of the inner mandrel being shiftable relative to said housing and another portion being non-shiftable; plug means closing the bore of the non-shiftable portion of said inner mandrel and preventing fluid from passing through the mandrel in either direction; a fluid bypass between said housing and said mandrel communicable with the mandrel bore on opposite sides of said plug means; means on said shiftable portion of said mandrel for moving said shiftable mandrel portion in a first direction in response to fluid pressure in said fluid bypass; first valve means opening movement of said shiftable mandrel portion in said first direction for establishing communication between said mandrel bore and said fluid bypass on one side of said plug means to permit downward fluid flow therethrough; and second valve means on the opposite end of said shiftable mandrel portion for establishing communication between said mandrel bore and the exterior of said housing, said second valve means being closed when said first valve means is open and open when said first valve means is closed, whereby fluid cannot pass from the exterior of said housing into the mandrel bore and past said plug means in an upward direction.

8. The valve apparatus of claim 7 further comprising biasing means opposing movement of said shiftable mandrel portion in said first direction.

9. The valve apparatus of claim 8 wherein said first valve means is shiftable relative to said plug means, said first valve means and said plug means defining a restricted flow passage during an initial interval of movement of the first valve means, the flow past said first valve means being increased during a subsequent interval of movement of the first valve means.

* * * * *